United States Patent [19]

Wood

[11] 4,234,114

[45] Nov. 18, 1980

[54] ARTICLE CARRIER

[75] Inventor: Prentice J. Wood, Hapeville, Ga.

[73] Assignee: The Mead Corporation, Dayton, Ohio

[21] Appl. No.: 10,817

[22] Filed: Feb. 9, 1979

[51] Int. Cl.[3] ..... B65D 71/00

[52] U.S. Cl. ..... 224/45 A; 206/510

[58] Field of Search ..... 224/45 A, 45 AB; 206/162, 506, 505, 504, 510, 515; 229/28 BC, 28 R, 29 D; 220/21, 22

[56] References Cited

U.S. PATENT DOCUMENTS

| | | | |
|---|---|---|---|
| 2,314,896 | 3/1943 | Powell | 224/45 AB |
| 2,393,114 | 1/1946 | Lyons, Jr. | 229/28 BC |
| 2,820,586 | 1/1958 | Gerald | 229/290 |
| 3,587,915 | 6/1971 | Theobald et al. | 206/510 |
| 3,744,704 | 7/1973 | Struble | 229/28 BC |
| 3,991,879 | 11/1976 | Hirota | 206/510 |
| 4,040,517 | 8/1977 | Torokvei | 206/510 |
| 4,079,077 | 3/1978 | David | 206/504 |

*Primary Examiner*—Joseph J. Rolla
*Assistant Examiner*—Kenneth Noland
*Attorney, Agent, or Firm*—Rodgers & Rodgers

[57] ABSTRACT

An article carrier comprising bottom structure (23–34), a pair of side walls (1,6) integrally joined respectively to the sides of the bottom structure, a pair of end walls (2,3) integrally joined to the ends of the bottom structure and with the ends thereof integrally joined respectively to adjacent ends of the side walls, transverse partition structure (14–17) integrally joined to the side walls and extending therebetween, longitudinal partition structure (18,19) integrally joined to the end walls and extending therebetween and being integrally joined to the transverse partition structure to form multiple article receiving cells, handle structure (35) disposed in vertical alignment with the longitudinal partition structure, and a handle receiving pocket (20) defined by the longitudinal partition structure.

6 Claims, 5 Drawing Figures

ARTICLE CARRIER

TECHNICAL FIELD

This invention relates to the packaging of multiple articles in a nestable type carrier of minimum width and with sufficient article separation.

BACKGROUND ART

It is well known to package articles in various multiples and with sufficient separation between the articles to prevent undesirable breakage. It is also well known to nest the upstanding handle structure of an article carrier, in various ways, with an adjacent carrier in order to effect economy of shipping space. In the past this has resulted in a carrier width dimension which is too wide for loading into normal sized shipping cases.

DISCLOSURE OF INVENTION

An article carrier comprising bottom structure, integrally joined side and end walls, transverse and longitudinal partition structure integrally joined to form multiple article receiving cells, handle structure, a handle receiving pocket defined by the longitudinal partition structure, and the transverse width of each article receiving cell adjacent the bottom structure being less than the diameter of the corresponding article to be packaged.

BEST MODE FOR CARRYING OUT THE INVENTION

Figure 1:
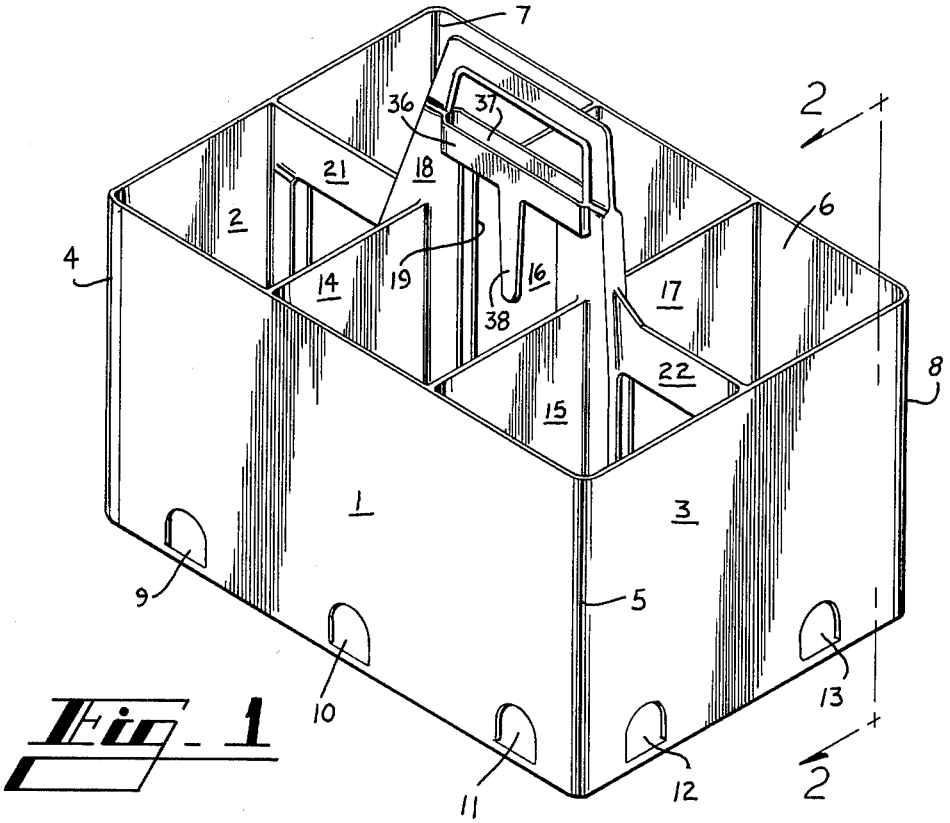
FIG. 1 is an isometric view of an article carrier formed according to this invention.

In the drawings the numeral 1 designates a side wall of the carrier to the ends of which end walls 2 and 3 are integrally joined at junctions 4 and 5 respectively. In like manner side wall 6 is integrally joined to end walls 2 and 3 at junctions 7 and 8 respectively. Heel receiving apertures 9, 10 and 11 are formed in the lower portion of side wall 1 and, likewise, heel receiving apertures 12 and 13 are formed in the lower portion of end wall 3. Although not shown in the drawings corresponding heel receiving apertures are formed in end wall 2 and side wall 6. In order to facilitate removal of the carrier from the production mold, side walls 1 and 6 and end walls 2 and 3 each diverge outwardly from the bottom structure at an angle of approximately 1°.

For the purpose of providing proper separation for articles disposed in the longitudinal direction of the carrier, transverse partition structure is provided. More specifically transverse partitions 14 and 15 are integrally joined to the inside of side wall 1 and extend inwardly therefrom. In addition transverse partitions 16 and 17 are integrally joined to the inside of side wall 6 and extend inwardly therefrom.

Figure 2:
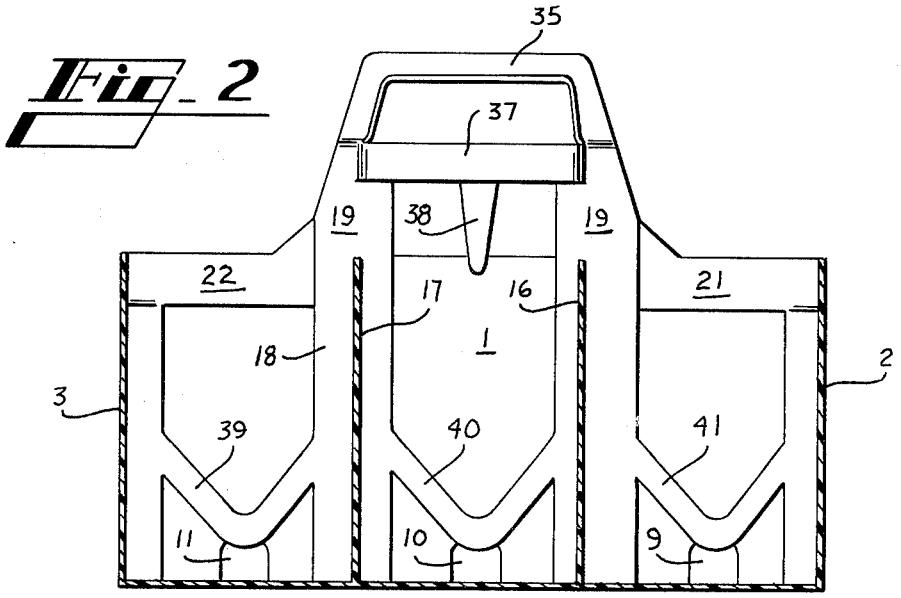
FIG. 2 is a view taken along the line 2—2 in FIG. 1.

In a similar manner, separation is provided for articles disposed in the transverse direction in the form of longitudinal partition structure. In general the longitudinal partition structure is of a double wall constructed in the form of longitudinal partitions 18 and 19 which extend the entire length of the carrier and with the space therebetween defining a handle receiving pocket 20. As best shown in FIG. 2, the portion of each longitudinal partition 18 and 19 disposed in the middle of each article receiving cell is cut out. To complete the longitudinal partition structure, upper longitudinal partition 21 is provided at one end of the carrier and extends inwardly from end wall 2 and, likewise, upper longitudinal partition 22 is formed at the other end of the carrier and extends inwardly from end wall 3.

Figure 4:
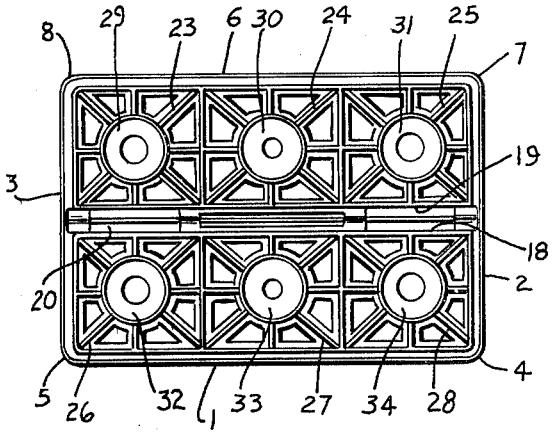
FIG. 4 is a bottom plan view.
Figure 5:
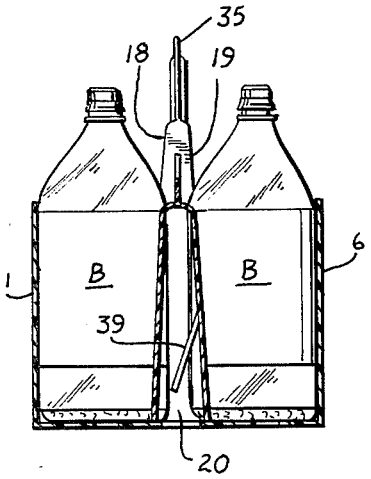
FIG. 5 is an end elevational view with the associated end wall removed and with articles disposed in the carrier.

As best viewed in FIG. 4, the bottom structure for the carrier is formed by mesh structures 23–28 which are associated respectively with each individual article receiving cell. For the purpose of cushioning the packaged articles, dome shaped pads 29–34 are formed respectively in the center of mesh structures 23–28.

In order to conveniently transport the carrier, handle 35 is integrally joined to the upstanding portions of longitudinal partitions 18 and 19. To complete the handle structure, support strips 36 and 37 are provided at the base of handle 35 and are offset from the longitudinal medial line of the carrier.

For the purpose of providing separation between the upper portions of the articles disposed in the center cells of the carrier, separation tab 38 extends downwardly from support strip 36. In order to enhance the adaptability of separation tab 38 to various size articles, the lower portion thereof is yieldable.

Separation between the lower portions of the articles disposed in the transverse direction of the carrier is provided by V-shaped separation elements 39, 40, and 41 each of which is integrally joined at the ends thereof to the associated portions of longitudinal partition 19. Also the lower portion of each of the V-shaped separation elements 39, 40, and 41 is yieldable in order to accommodate lateral movement of the packaged articles.

Figure 3:
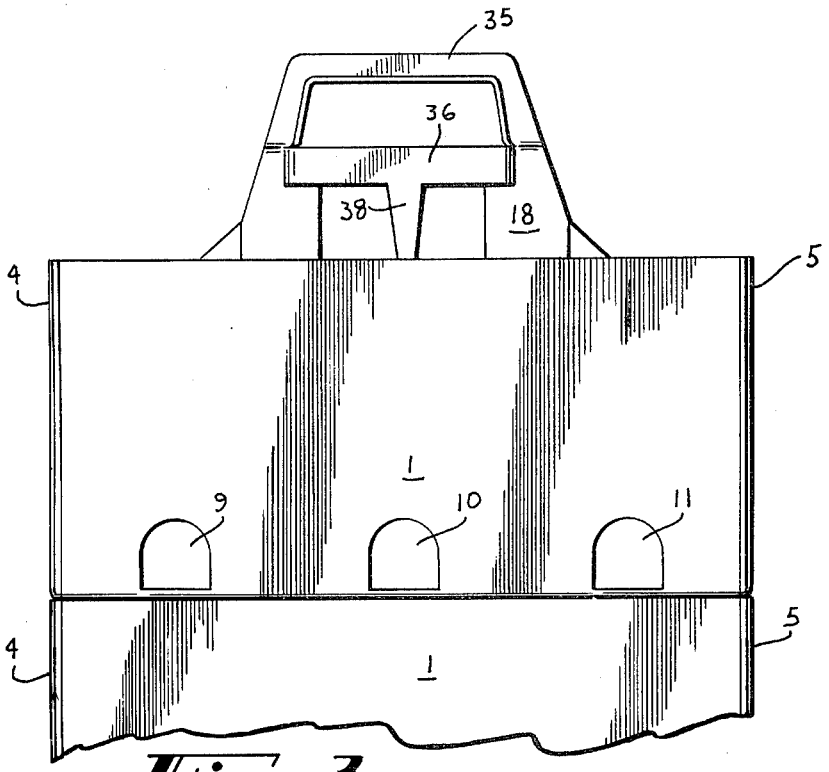
FIG. 3 is a side elevational view of a pair of nested carriers with a portion of the lower carrier broken away.

In order to save transportation and storage costs, article carriers constructed according to this invention are nestable due to longitudinal partitions 18 and 19 being spaced apart to define handle receiving pocket 20. The handle of an adjacent carrier can be conveniently inserted into the handle receiving pocket 20 of a carrier stacked immediately above as shown in FIG. 3.

Normally the width of a pair of bottles in addition to the width of handle receiving pocket 20 would be too great to allow the carrier to fit into a regular multiple carrier case. Therefore by this invention the portion of each longitudinal partition 18 and 19 disposed at the midsection of each associated article receiving cell is cut out and each longitudinal partition diverges outwardly from the upper portion of the carrier at an angle of approximately 7°. As a result the interior portion of each packaged article B extends into the lower portion of handle receiving pocket 20 with the base of each article B disposed in face contacting relation with the associated mesh structure 23–28. Also the lower portions of adjacent bottles B disposed transversely of the carrier are cushioned by means of V-shaped separation elements 39, 40 and 41 and, similarly, the upper portions thereof are cushioned either by means of upper longitudinal partitions 21 and 22 or by means of separation tab 38.

INDUSTRIAL APPLICABILITY

Therefore by this invention an article carrier is provided which conveniently fits into a standard carrier case and, in addition, provides proper separation between articles packaged in both the longitudinal and transverse directions of the carrier.

I claim:

1. An article carrier comprising bottom structure (23–34), a pair of side walls (1,6) integrally joined respectively to the sides of said bottom structure and extending upwardly therefrom, a pair of end walls (2,3) integrally joined respectively to the ends of said bottom structure and extending upwardly therefrom, the ends of said side walls being integrally joined respectively to the adjacent ends of said end walls, transverse partition structure (14–17) integrally joined to said side walls and extending therebetween, longitudinal partition structure (18,19) integrally joined to said end walls and extending therebetween, said longitudinal partition structure being integrally joined to said transverse partition structure to form multiple article receiving cells, handle structure (35) disposed in vertical alignment with said longitudinal partition structure and extending upwardly therefrom, a handle receiving pocket (20) defined by said longitudinal partition structure, the transverse width of each of said article receiving cells adjacent said bottom structure being less than the diameter of the corresponding article to be packaged, and characterized by a pair of support strips (36,37) being disposed at the base of said handle structure generally parallel to said side walls and offset from the longitudinal medial line of the carrier, a separation tab (38) being joined to one of said support strips and extending downwardly therefrom, the bottom portion of said separation tab being yieldable, and a V-shaped separation element (39–41) being disposed between adjacent portions of said longitudinal partition structure associated with one of said article receiving cells and the midportion thereof being yieldable.

2. An article carrier according to claim 1 and further characterized in that said longitudinal partition structure comprises a pair of longitudinal partitions (18,19) and said longitudinal partitions diverge downwardly respectively from the upper portion of the carrier.

3. An article carrier according to claim 2 and further characterized in that the angle of divergence of each of said longitudinal partitions is approximately 7°.

4. An article carrier according to claim 1 and further characterized in that said longitudinal partition structure comprises a pair of longitudinal partitions and said V-shaped separation element is disposed between adjacent portions of one of said longitudinal partitions.

5. An article carrier according to claim 1 and further characterized in that an article (B) is disposed in one of said article receiving cells with the bottom thereof disposed in face contacting relation with the bottom structure of said one cell and a portion of said article extends into said handle receiving pocket.

6. An article carrier according to claim 5 and further characterized in that a portion of said longitudinal partition structure associated with said one article receiving cell is cut out and said article is disposed in said cut out portion.

* * * * *